United States Patent [19]

Vecchi

[11] 4,235,089

[45] Nov. 25, 1980

[54] PROGRESSIVE STAMPING PRESS

[76] Inventor: John C. Vecchi, 1603 Third St., Natrona Heights, Pa. 15065

[21] Appl. No.: 43,163

[22] Filed: May 29, 1979

[51] Int. Cl.[3] ..... B21D 37/04

[52] U.S. Cl. ..... 72/472; 72/325; 72/404; 83/528; 83/620

[58] Field of Search ..... 72/472, 462, 413, 404, 72/325; 83/527, 528, 572, 571, 620

[56] References Cited

U.S. PATENT DOCUMENTS 3,949,589 4/1976 Johnson ..... 72/413

FOREIGN PATENT DOCUMENTS 11571 of 1906 United Kingdom ..... 72/404

954482 4/1964 United Kingdom ..... 72/462

*Primary Examiner*—Leon Gilden
*Assistant Examiner*—Gene P. Crosby
*Attorney, Agent, or Firm*—Brown, Flick & Peckham

[57] ABSTRACT

A continuous metal strip is fed lengthwise along a line of dies intermittently from one end of the line to the other beneath a vertically reciprocating ram carrying a plurality of punches that are slidable vertically in the ram from a projecting operating position to a retracted inoperative position. Each punch is selectively movable automatically from either of those positions to the other independently of the rest of the punches so that different punches can punch a strip at different times while the strip is passing through the press.

8 Claims, 7 Drawing Figures

PROGRESSIVE STAMPING PRESS

In conventional progressive stamping presses the punches are mounted in fixed position in the ram. While the press is operating with a given set of punches, only the pattern formed in the metal strip by that set can be produced. When it is desired to punch a different pattern, it is necessary to stop the press and either remove some of the punches, add punches or remove some and add others. To do this requires a considerable amount of time, which means lost production.

It is among the objects of this invention to provide a progressive stamping press, in which some, if not all, punches are slidably mounted in the ram and can be moved from projecting operating positions to retracted inoperative positions, in which there are means for automatically moving each punch from either of the positions to the other independently of the rest of the punches, and in which such movement of the punches is controlled in accordance with a predetemined program under the control of a moving element of the press.

The preferred embodiment of the invention is illustrated in the accompanying drawings, in which FIG. 1 is a diagrammatic side view of the press and its control unit;

Figure 4:
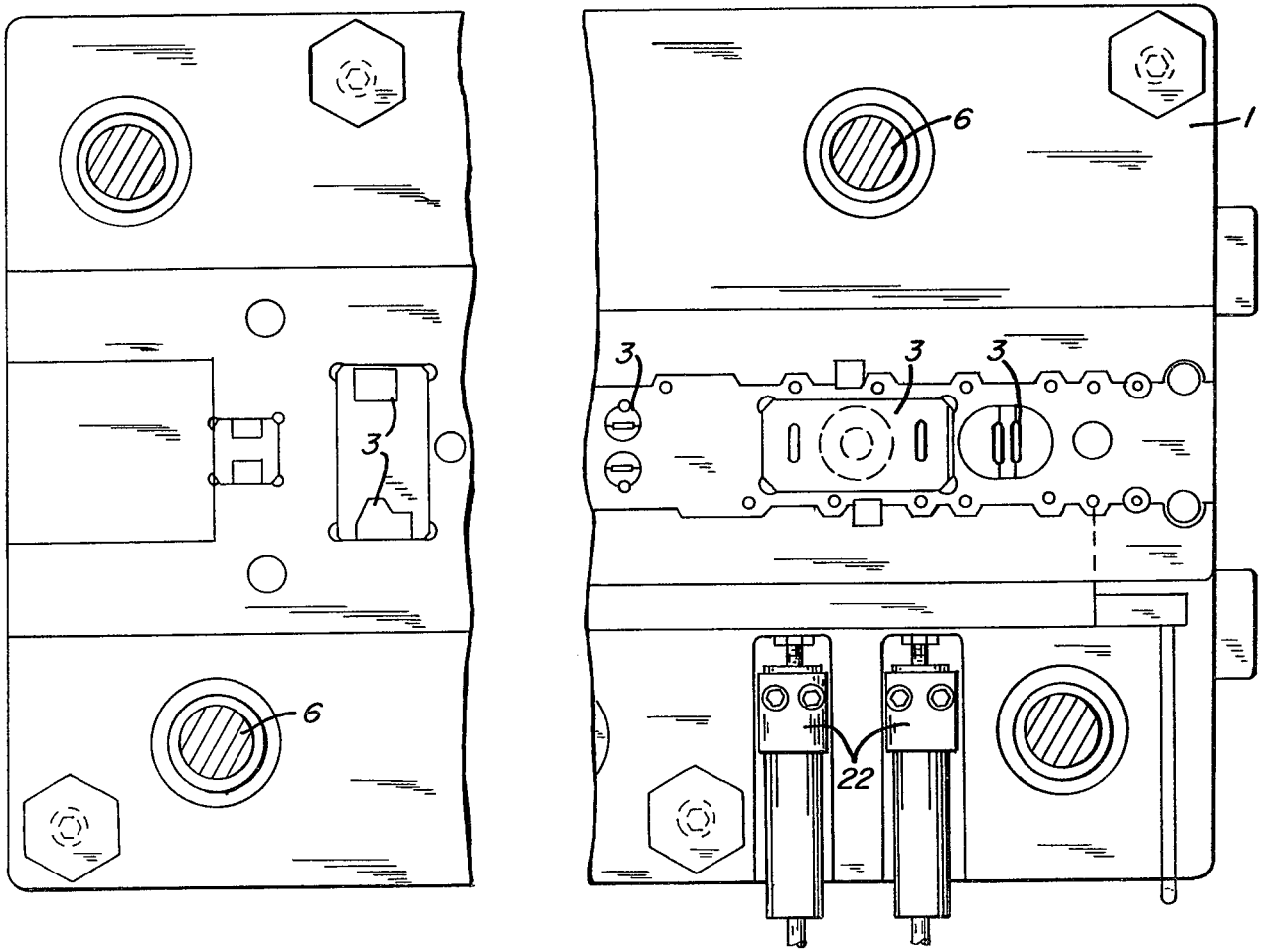
FIG. 4 is a fragmentary plan view of the die holder.
Figure 5:
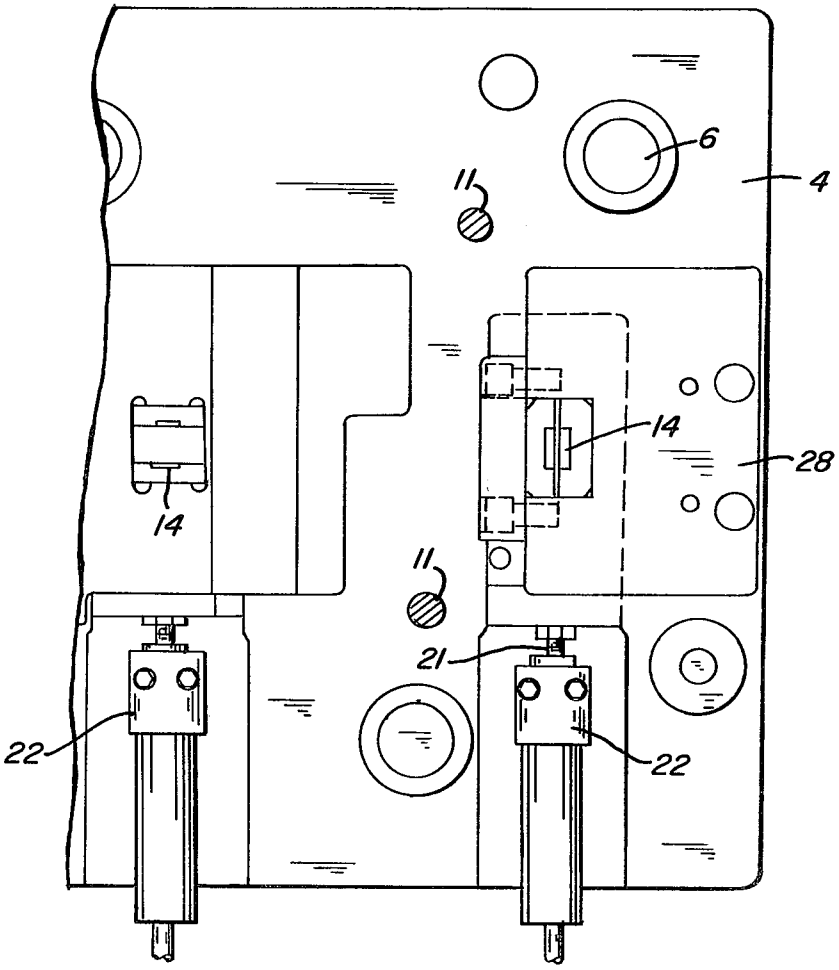
FIG. 5 is a fragmentary view of the bottom of the ram.
Figure 5:
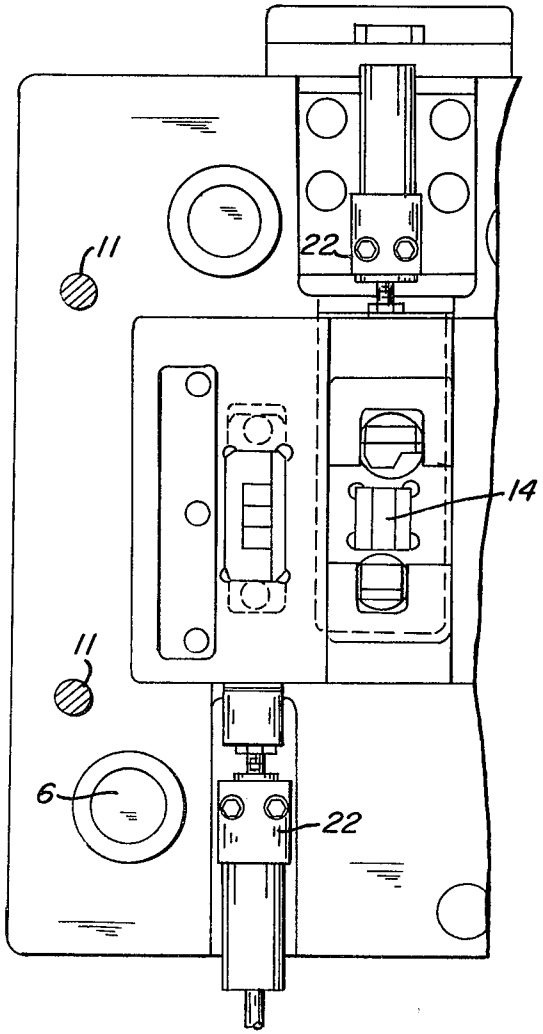

Referring to the drawings, a die holder 1 is rigidly supported by the frame 2 of a progressive stamping press of known construction, such as a Bruderer press, and the die holder supports a line of dies 3 (FIG. 4) that may be provided with vertical openings through them and/or downwardly extending recesses that do not extend through the dies. Spaced above the die holder is a ram 4 that is supported in the stamping press by a conventional head 5, by which it can be reciprocated vertically to move it toward and away from the die holder continuously. To guide the ram in its vertical movements, the upper ends of guide posts 6 are rigidly mounted in it, with the posts extending down into bearings 7 in vertical passages in the die holder.

Between the ram and die holder there is a floating stripper plate 10 supported by studs 11 rigidly mounted in the plate and slidably mounted in the ram for limiting the distance the plate can move down away from the ram. The stripper plate also is slidably mounted on guide posts 6. When the ram is in its upper position at the top of its stroke, studs 11 hold the stripper plate above the dies. When the ram approaches the bottom of its stroke, the stripper plate engages the top of the workpiece in the form of a metal strip 12, which stops downward movement of the place and studs while the ram continues to move down a short distance to punch the strip. When the ram starts to move up again, the stripper plate remains against the strip until the ram and studs lift the plate after the punches have been withdrawn from the strip.

The metal strip 12 is unwound from a reel at one side of the press, staightened and pushed across the dies from one end of the die holder to the other by means of intermittently rotating feed rollers (not shown). Intermittently rotating rollers for feeding continuous metal strip through progressive stamping presses are shown in U.S. Pat. Nos. 3,589,221 and 3,889,565 as examples. In this manner the strip is fed or progressed a predetermined distance every time the ram moves upwardly. When the ram moves down, the strip is punched by punches carried by the ram. Some of these punches may pierce the strip while others may be formed to only bend areas of it downwardly. If desired, the die support may also be provided with upwardly projecting punches that bend areas of the strip upwardly into recesses in the stripper plate. The press described thus far is conventional.

It is a feature of this invention that some or all of the punches carried by the ram are adjustable vertically in the ram between two positions. In its lower position such a punch 14 projects from the ram into operating or punching position. In its upper or retracted position the punch does not project far enough to punch and therefore is inoperative. To accomplish this vertical adjustment of a punch in accordance with this invention, its upper end has laterally projecting shoulders 15 that are supported by laterally spaced ledges 16 of a slide 17 that overlies the punch and has a lower surface 18 engaging the upper end of the punch and provided with an inclined cam surface. The slide is mounted in a downwardly opening recess 19 in the bottom of the ram and is held in engagement with the upper wall of the recess by a plate 20 secured to the bottom of the ram and engaging the bottom of the slide. Part of the upper surfaces of ledges 16 and part of the bottoms of the punch shoulders are inclined in the same direction and to the same extent as the overlying cam surface of the slide. Also, part of the top of the punch is inclined to the same extent as the cam surface it engages.

Figure 7:
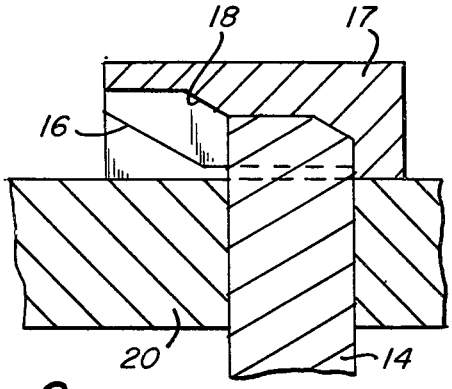
FIG. 7 is a fragmentary longitudinal section of a punch extender and retractor with the punch extended.
Figure 2:
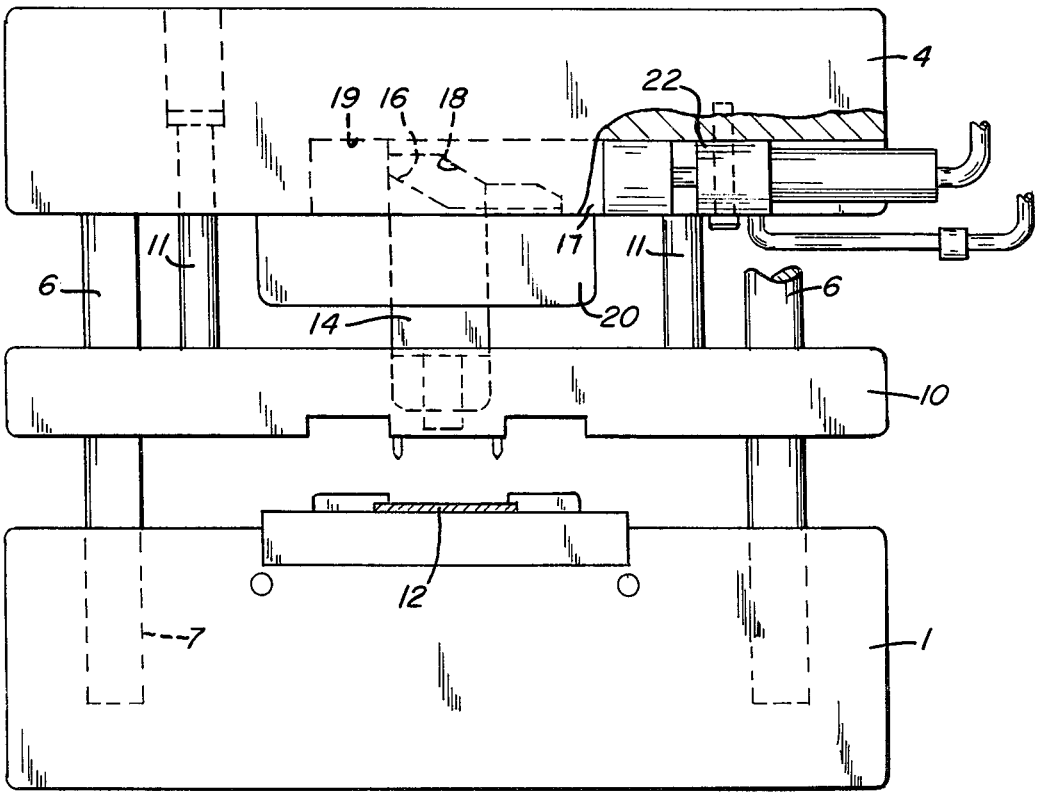
FIG. 2 is an enlarged end view of the die holder, ram and stripper plate of the press.
Figure 3:
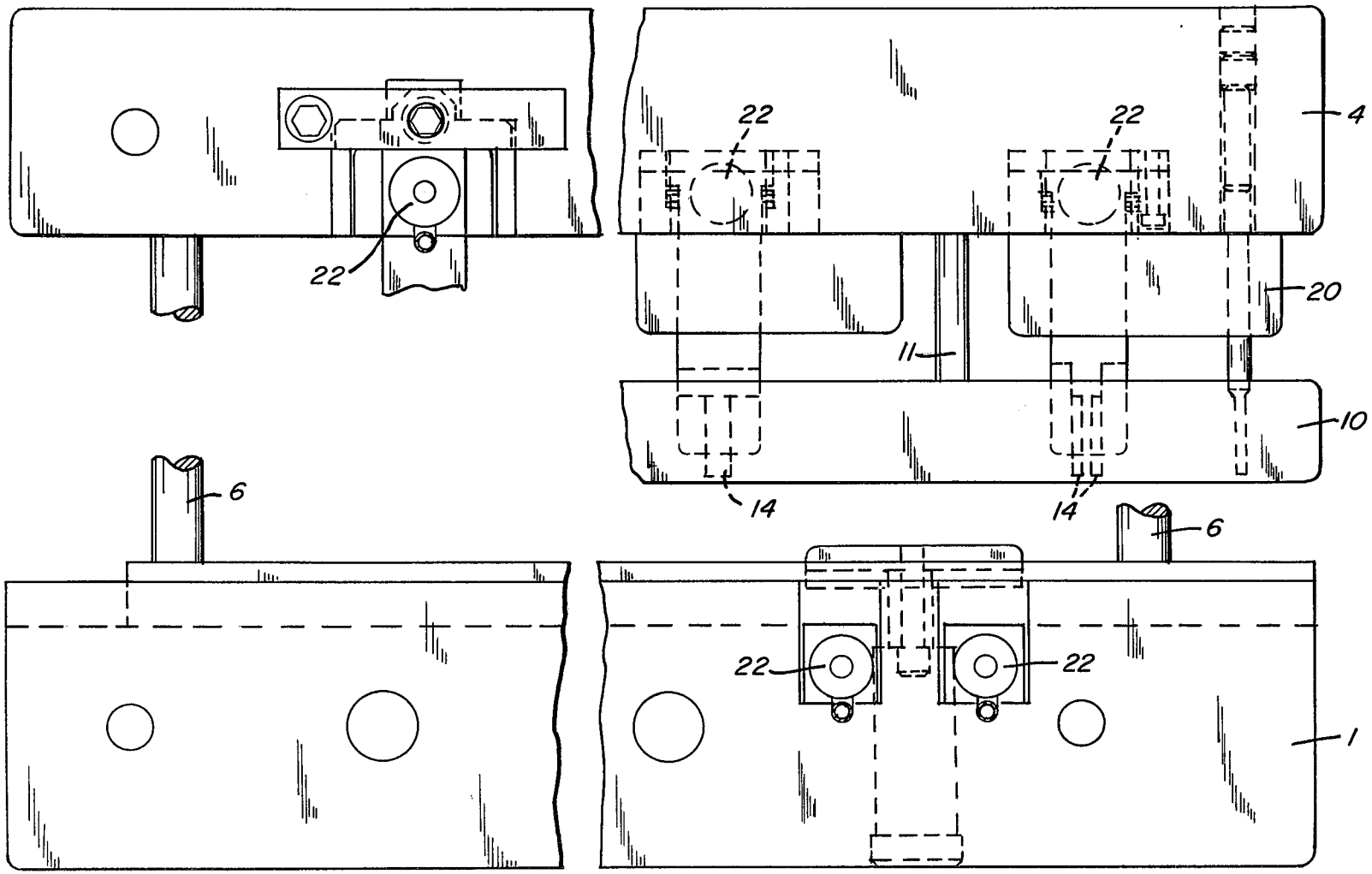
FIG. 3 is a fragmentary side view of the same elements.

One end of slide 17 is connected to the rod 21 of a piston in an air cylinder 22 that is secured to the ram. The cylinder has two openings, one for compressed air to move the piston in order to move the slide in one direction and the other for moving the piston and slide in the opposite direction. When the slide is moved in one direction the inclined ledges 16 raise or retract the punch, but when the slide moves in the opposite direction its downwardly facing cam forces the punch down into operative position. At least half of the area of the top of the punch, extending from its inclined area toward the upper end of the slide's lower surface 18 is horizontal. Also, when the slide is in position that projects the punch from the ram, as shown in FIG. 7, a horizontal area of its lower surface likewise overlies and engages the horizontal area at the top of the punch. The engagement of these two horizontal areas prevents the upward pressure of the punch from causing the slide to move at right angles to the punch and allowing the punch to move up in the ram. If desired, ledges 16 can be omitted and their places taken by coil springs that raise the punches when the slides are retracted.

Each of the slide cylinders 22 is connected by flexible tubing 23 to a solenoid valve 24 (FIG. 1) which, in one position, delivers air under pressure from a conventional pressure source to one end of the cylinder, and in the other position delivers air pressure to the opposite end of the cylinder. The valves are separately and electrically connected by cables 25 to control apparatus 26 for energizing the valves independently of one another. This control apparatus can be programmed to connect an electric power supply with the wires leading to any desired valve, whereby to open the different valves in any desired sequence or combination in order to punch the metal strip according to the desired pattern.

Figure 1:
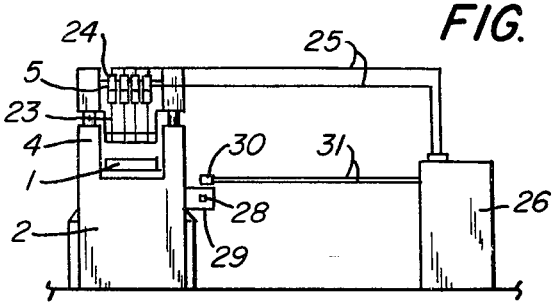
Figure 6:
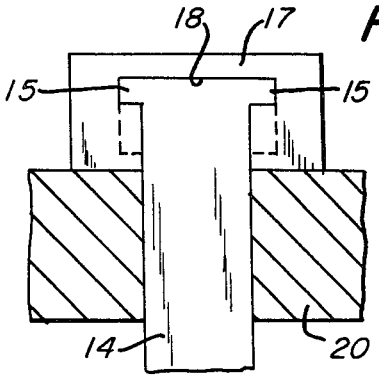
FIG. 6 is an end view of a punch actuator with the punch retracted.

The control apparatus is energized once every cycle of the ram by means connected to a moving part of the press. Preferably, as shown in FIG. 1, it is done by a magnet 28 attached to the drive shaft 29 of the press, which makes one revolution for each press stroke. At each revolution of the shaft the magnet trips a normally open switch 30 that is connected by an electric cable 31 to the control apparatus and thereby connects the power supply with the wires leading to the valves that are to be actuated according to the stamping program. Consequently, the ultimate control of the punching pattern is determined by the movements of the press itself. The press is timed so that, after each hit, the punches will be projected or retracted in accordance with the desired punching program before the next hit. The position of the magnet on the drive shaft determines this timing.

With a press constructed in accordance with this invention, it is unnecessary to change punches when it is desired to punch a different pattern. All that is required is to reprogram the control apparatus, which can be done quickly, and then only the necessary punches will appear in operating position.

According to the provisions of the patent statues, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. In a progressive stamping press having an elongated die support, a plurality of dies on said support spaced apart lengthwise thereof, and a vertically reciprocable ram above the die support, the improvement comprising a plurality of punches carried by said ram above said dies and slidable vertically relative to the ram from a projecting operating position to a retracted inoperative position, and means carried by the ram for selectively moving each punch from either of said positions to the other independently of the rest of the punches so that different punches can punch a strip at different times while a continuous metal strip is passing through the press.

2. In a progressive stamping press according to claim 1, said moving means for each retracted punch comprising a horizontally movable slide overlying the punch and having an inclined lower cam surface engaging the upper end of the punch, and means for moving the slide across the top of the punch in one direction to cause said cam surface to move the punch downwardly to operating position.

3. In a progressive stamping press according to claim 2, the top of said punch having a horizontal area and an inclined area slanting therefrom downwardly in the same direction as said cam surface of the slide, and said lower surface of the slide including a horizontal area for engaging said horizontal area of the punch when the punch is in its projecting position.

4. In a progressive stamping press according to claim 2, the bottom of said ram being provided with downwardly opening recesses, said slides being disposed in the recesses, and means secured to the bottom of the ram supporting the slides in the recesses in engagement with the upper walls of the recesses.

5. In a progressive stamping press according to claim 2, the upper end of the punch having laterally projecting shoulders and said slide having laterally spaced ledges engaging the bottom of the shoulders and provided with upper cam surfaces inclined in the same direction as said cam surface of the slide for raising the punch when the slide is moved across the top of the punch in the opposite direction.

6. In a progressive stamping press according to claim 2, an air cylinder for each slide, a piston in each cylinder connected with the adjacent slide, and means for conducting air pressure to the cylinder and for releasing air therefrom to cause the piston to move the slide back and forth.

7. In a progressive stamping press according to claim 6, said air-conducting means including an electrically-operated valve, and means for actuating the valve.

8. In a progressive stamping press according to claim 7, said valve-actuating means including an electric circuit connected with the valve, a normally open switch controlling said circuit, and movable means synchronized with the movements of the press for closing the switch.

* * * * *